United States Patent [19]

Eichenlaub

[11] Patent Number: 4,798,007

[45] Date of Patent: Jan. 17, 1989

[54] EXPLOSION-PROOF, POLLUTION-FREE INFRARED DRYER

[76] Inventor: John E. Eichenlaub, 9426 Beverly La., Sanibel Island, Fla. 33957

[21] Appl. No.: 54,999

[22] Filed: May 28, 1987

[51] Int. Cl.[4] ..... F28B 3/28

[52] U.S. Cl. ..... 34/4; 34/36; 34/40; 34/86

[58] Field of Search ..... 34/4, 39, 40, 41, 36, 34/86, 68

[56] References Cited

U.S. PATENT DOCUMENTS

| | | | |
|---|---|---|---|
| 3,849,063 | 11/1974 | Eichenlaub | 34/4 |
| 4,135,098 | 1/1979 | Troue | 34/41 |
| 4,330,946 | 5/1982 | Courneya | 34/86 |
| 4,336,279 | 6/1982 | Metzger | 34/4 |
| 4,594,795 | 6/1986 | Stephansen | 34/156 |

*Primary Examiner*—Henry A. Bennet
*Attorney, Agent, or Firm*—Palmatier & Sjoquist

[57] ABSTRACT

An explosion-proof, pollution-free infrared dryer for concentrated vaporization and removal of combustible solvent from a newly coated product, such as a newly printed web of paper, having a pair of opposing infrared radiant heater or burner sources each contained within a combustion chamber having a radiation transmissive wall confronting the infrared source.

A drying tunnel for surrounding and passing the newly coated product or web therethrough is located in the ambient room air space between the infrared sources. The drying tunnel preferably is made of radiation transmissive panels to permit irradiation by the infrared source upon the web while yet containing and concentrating the vaporized combustible solvent.

A combustion inhibiting atmosphere (CIA) flows through the drying tunnel. The CIA cools the web and effectively removes the concentrated, vaporized combustible solvent from the drying tunnel away from the web and infrared sources preferably for reclamation in a CIA cooling and condensate collection system. Thereafter, the CIA may be recirculated within the drying tunnel.

The infrared dryer is appropriately provided with a hot air impact preheater for passing the web therethrough before its entrance into the drying tunnel. The preheater vaporizes a portion of the combustible solvent and improves the infrared absorption of the web as it next travels into the drying tunnel. The preheater may be efficiciently supplied with hot air from a heat exchanger receiving hot exchaust gases from the infrared heater sources.

36 Claims, 3 Drawing Sheets

EXPLOSION-PROOF, POLLUTION-FREE INFRARED DRYER

BACKGROUND OF THE INVENTION

This invention relates to an explosion-proof, pollution-free infrared dryer for concentrated vaporization and removal of combustible or flammable solvents from a newly coated product, such as a newly printed web of paper or a newly applied adhesive on a web of material.

Removal of a combustible solvent from a newly applied coating involves at least three problematic considerations. First, known methods which generate necessary temperatures in the range of 180°–450° F. are expensive and inefficient in operation. Secondly, precautions must be exercised because the solvents are combustible and may cause explosions. Finally, release of vaporized solvents into the atmosphere causes pollution.

Drying newly applied coatings dispersed with flammable solvents has been accomplished in the past by hot air impact drying ovens. This method works reasonably well but has its drawbacks. Explosion control is typically accomplished by dilution or scattering of the combustible solvent molecules in vast volumes of heated air to extremely low concentration levels. This method is expensive in that it involves heating up high volumes of air for rapid circulation about the coating to be dried. Thereafter, the vast volumes of solvent-laden hot air must cooled so that the widely scattered solvent molecules can be recaptured or condensed.

Infrared radiant heaters, such as the fuel-fired Schwank-type, are known to be used for drying products and for heating various enclosures. Infrared is unique in that it is not heat but rather radiant energy that generates heat when it enters an absorbent material much like electricity flowing into a resistor. Exemplary of such heaters are those shown in my prior U. S. Pats. Nos. 3,315,656; 3,797,474 and 3,849,063. Gas-fired infrared is desirable because it costs one-third to one-half as much as electric infrared in most instances, which in turn generally costs less than hot air impact ovens that are utilized in drying materials.

Combustible solvents typically used in printing and applying inks, adhesives and the like, are highly absorbent of infrared. They have many carbon-carbon and carbon-hydrogen bonds. These bonds make the solvents highly absorbent of infrared in the 2–4 mu range. Ink pigments are also highly absorbent of infrared. White coated paper, however, absorbs very little infrared.

Hot air impact drying and infrared drying complement each other. Newly printed ink dispersed with a combustible solvent is comprised essentially of various sized dots printed on a web of paper. For very tiny dots of ink hot air impact drying works reasonably well. This is so because the very tiny dots have a great deal of surface per unit weight which will permit losses of its solvent readily when heated by conduction. Large ink dots or masses, on the other hand, have just the opposite quality. Their low surface-mass ratio makes conduction drying difficult. However, under infrared radiation heat readily builds up within a mass undergoing infrared absorption. The heat drives the solvent out of the mass into a vaporized state. Thus, the two drying methods used together would complement each other to remove a combustible solvent from a newly printed web.

SUMMARY OF THE INVENTION

An explosion-proof, pollution-free infrared dryer for concentrated vaporization and removal of combustible solvent from a newly coated product, such as a newly printed web of paper, having a pair of opposing infrared radiant heater or burner sources each contained within a combustion chamber having a radiation transmissive wall confronting the infrared source.

A drying tunnel for surrounding and passing the newly coated product or web therethrough is located in the ambient room air space between the infrared sources. The drying tunnel preferably is made of radiation transmissive panels of film material to permit irradiation by the infrared source upon the web while yet containing and concentrating the vaporized combustible solvent.

Radiant heat for driving of the volatile solvents from the coatings or ink is supplied by gas fired infrared radiation panels separated from the drying funnel by an air space and a second infrared transmissive film panel, assuring to separate the infrared source from the tunnel and the volatile solvents therein.

A combustion inhibiting atmosphere (CIA) flows through the drying tunnel. The CIA mixes with the highly volatile vapors being driven off the coatings or ink on the web; and cools the vapors below their flash point. The cooling action condenses the vapor into fog and accordingly increases the carrying capacity of this CIA, which could carry less of the solvent in vapor form. The flowing CIA effectively removes the concentrated, combustible solvent from the drying tunnel away from the web and infrared sources, preferably for reclamation in a CIA cooling and condensate collection system. Thereafter, the CIA may be recirculated within the drying tunnel.

The infrared dryer is appropriately provided with a hot air impact preheater for passing the web therethrough before its entrance into the drying tunnel. The preheater vaporizes a portion of the combustible solvent and improves the infrared absorption of the web as it next travels into the drying tunnel. The preheater may be efficiently supplied with hot air from a heat exchanger receiving hot exhaust gases from the infrared heater sources.

After initial warm up of the infrared heater sources and the preheater, the CIA flow through the drying tunnel is commenced. The newly printed web of paper is then passed initially through the preheater for hot air impact drying of a portion of the combustible solvent and to improve the print's infrared absorption. Thereafter, the web is immediately fed through the drying tunnel for irradiation inrared sources. The constant flow flow of CIA within and out of the drying tunnel cools and vapor which condenses into a fog. The CIA removes the concentrated, vaporized combustible solvent out of the tunnel away from the web and infrared sources for solvent reclamation in the CIA cooling and condensate collection system, after which the CIA is recirculated back into the drying tunnel.

This invention advantageously provides an explosion-proof, pollution-free efficient infrared dryer which combines hot air impact and infrared drying which complement each other to thoroughly dry newly printed ink on a web. The infrared dryer is inexpensive because infrared drying generally costs less than past known air impact drying. Although air impact drying is utilized in the preheater, there still exists a substantial cost advantage and fuel economy because hot infrared burner exhaust gases are used in a heat exchanger to provide hot air for the preheater.

The infrared dryer of the present invention is explosion-proof in that the infrared burner or heater sources are separated from the concentrated, vaporized combustible solvent by not one but two radiation transmissive walls or panels as well as by ambient room air.

Additionally, the infrared dryer establishes and maintains a relatively small and reusable combustion inhibiting atmosphere, such as 35 percent carbon dioxide, which is a proven flame retardant and fire extinguishing agent.

The infrared dryer advantageously prevents solvent pollution into the atmosphere. Solvent recovery by this invention is made easy because the unscattered solvent molecules are in a relatively small amount of atmosphere which has been exposed to limited heating as the CIA cools the web.

The yieldable film walls of the drying tunnel and the film panels separating the infrared source from the tunnel will yield elastically in response to the unlikely ignition of the solvents supplied by the web, and instead of a damaging explosion, only a momentary flash will result, and will be far less likely to cause human injury than by trying to confine the explosion by an explosion door.

BRIEF DESCRIPTION OF THE DRAWINGS

FIG. 2 is a cross-sectional view taken along lines 2—2 of FIG. 1;

DETAILED DESCRIPTION OF THE INVENTION

Figures 1, 4B, 5, 6:
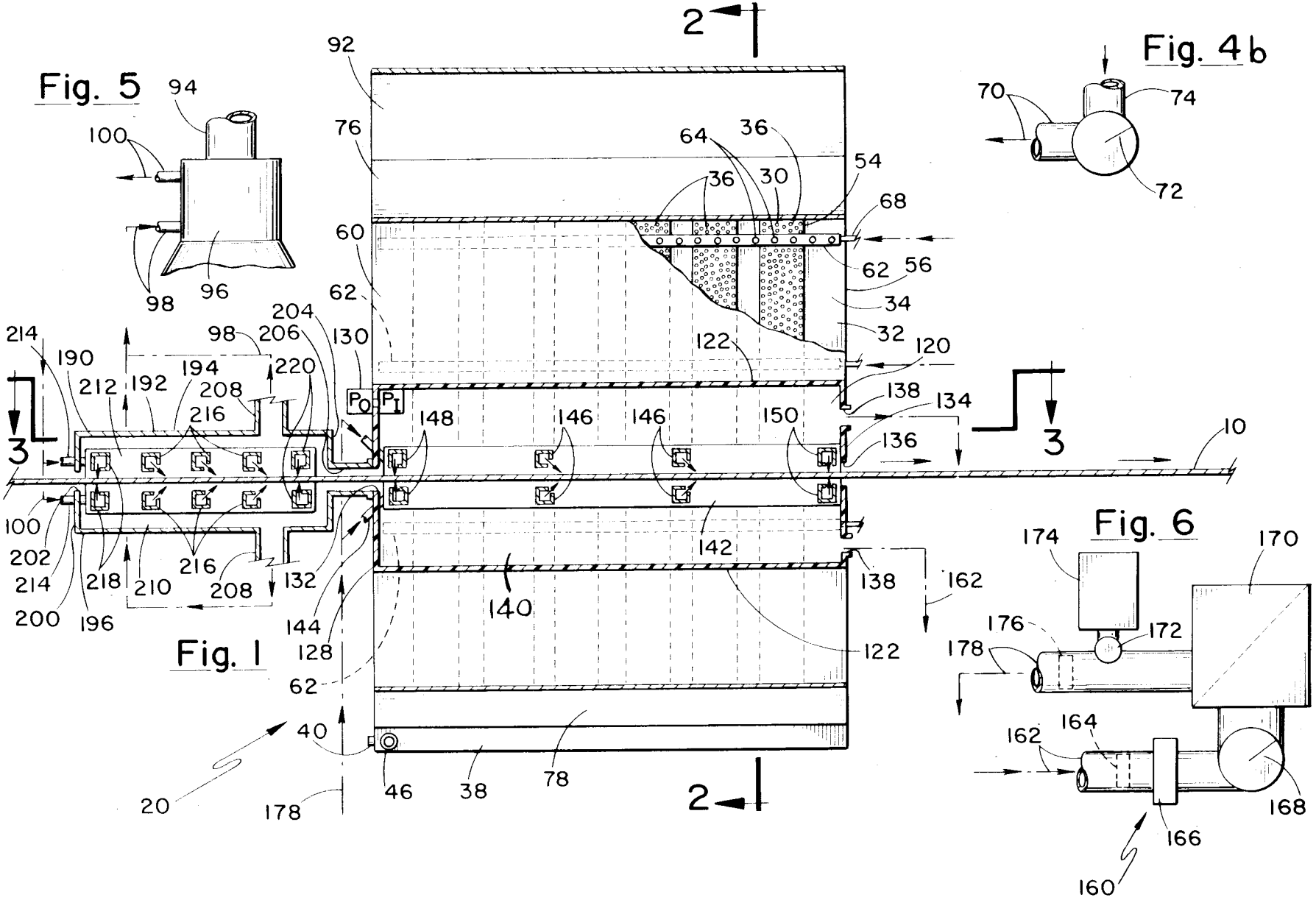
FIG. 1 is an longitudinal sectional view taken along lines 1—1 of FIG. 2 showing the explosion-proof, pollution-free infrared dryer of the invention.
FIG. 4*b* is a schematic view of the air source for the cooling tubes.
FIG. 5 is a schematic view of the heat exchanger for the air impact preheater of the invention.
FIG. 6 is a schematic view of CIA cooling and condensate collection system.
Figure 3:
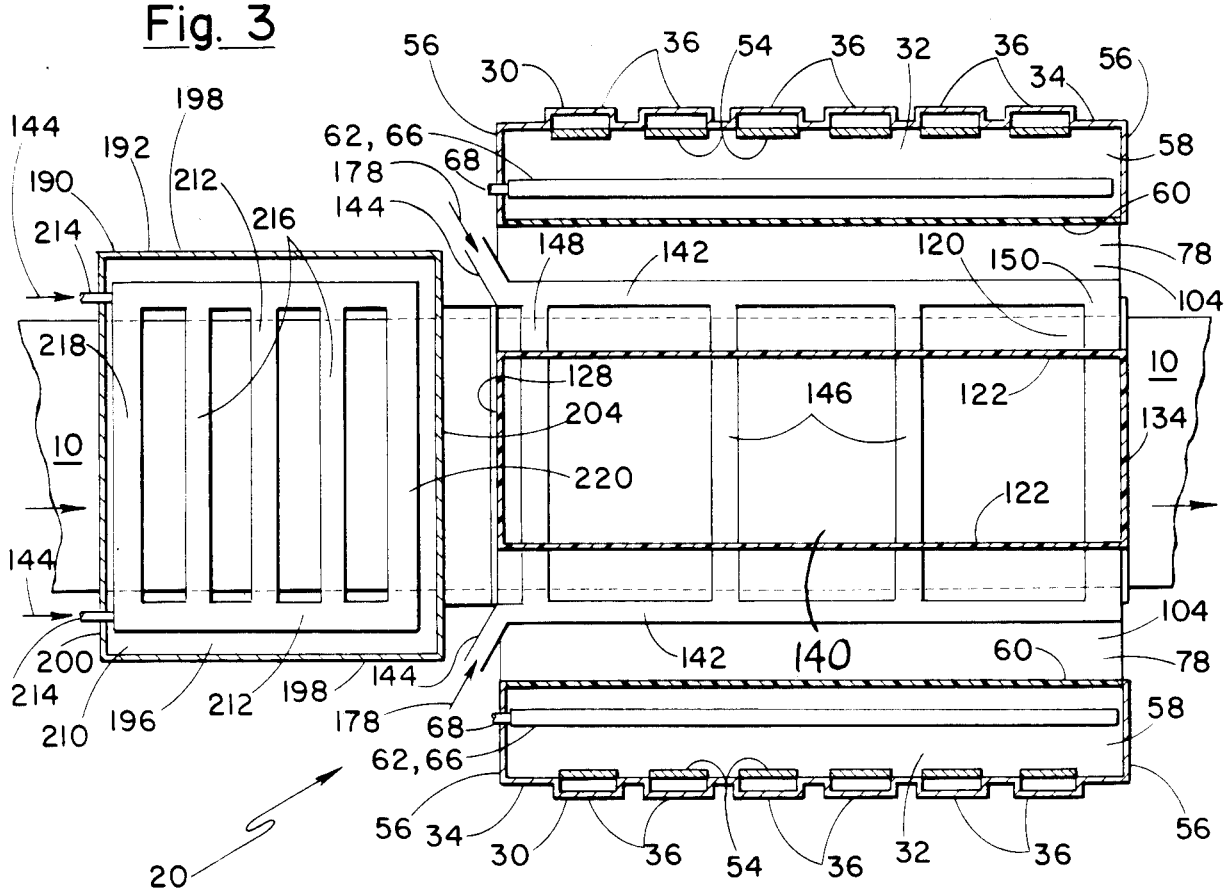
FIG. 3 is a cross-sectional view taken along lines 3—3 of FIG. 1.

Referring to FIGS. 1, 2 and 3, the explosion-proof, pollution-free infrared dryer 20 with a newly coated web 10 passing therethrough may be seen.

A pair of infrared radiant heater sources 30 are suitably arranged in an opposed and spaced apart relationship with ambient room air therebetween. Each infrared source 30 is of like construction and appropriately includes a combustion chamber 32 for housing the gas or fuel-fired type infrared source although electric infrared heaters may be used.

Combustion chamber 32 is bounded by a rigid structural mounting panel 34 wherein an array or bank of gas fired infrared Schwank-type infrared heaters or burners 36 are mounted, reflective sidewalls 56, reflective base plate 58 and radiation transmissive wall 60 made of film such as Teflon film made by E.I. DuPont DeNemours of Wilmington, Del., which is highly transmissive and minimally absorptive of infrared radiation. Combustion chamber's 32 infrared reflective sidewalls 56 and base plate 58 suitably may be made of polished aluminum.

Infrared heaters 36 are typically one to four feet long each generating up to 100,000 BTU/hour. Heater 36 size and output are obviously dependent upon the dryer's 20 size and intended use. Nonetheless, heaters 36 are elongate and are preferably vertically oriented. It has been found that their most intense radiation is generally directed at an angle of 30°-60° from the face of infrared heaters 36 and not directly in front or perpendicular to the front faces of heaters 36.

Gas fired infrared burners 36 appropriately have a base 38 containing a gas fuel line 40 with vertically oriented gas nozzles 42 near a venturi 44. Primary air nozzles 46 introduce primary combustion air, which is mixed with the gaseous fuel from nozzle 42, at venturi 44 above which combustion takes place.

Figure 4A:
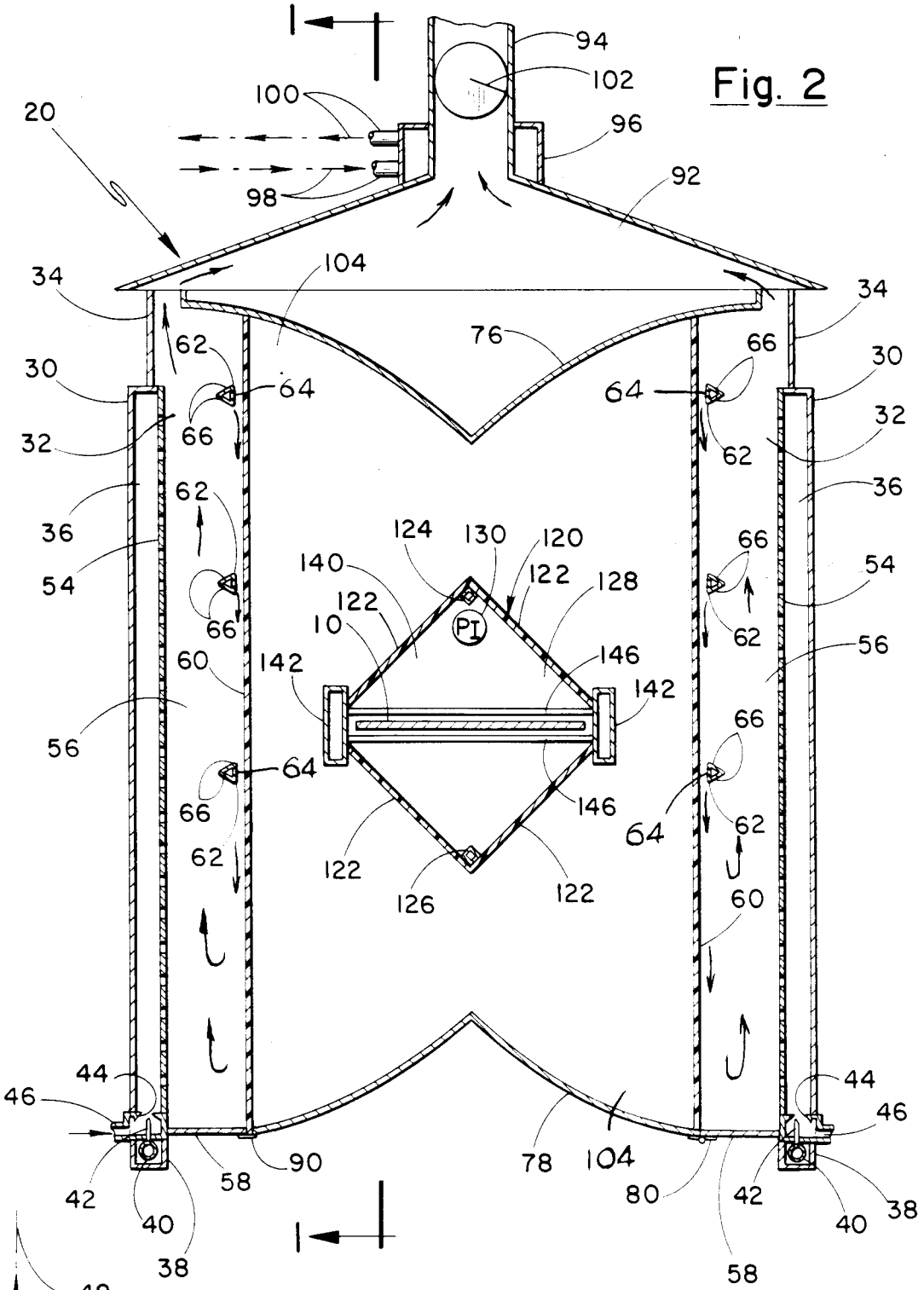
FIG. 4*a* is a schematic view of the primary air source for the infrared sources.

Primary air nozzle 46 is appropriately connected to primary air conduit 48 (FIG. 4*a*) which receives primary combustion air from primary air fan 50 which in turn draws air from ambient room air conduit 52. Burners 36 each have an infrared radiating panel 54 suitably made out of ceramic tile with a plurality of holes therein. The tile obviously should be resistent to combustion.

If burners 36 are desired to be sealed, segregated from ambient from air, air may be drawn from a concentric stack duct which may assure minimal interference with differentials in pressures as well as back drafts that otherwise may be realized.

The infrared radiation transmissive wall 60 may be made of any of a number of films, more specifically described as a thermoplastic material or film (tetrafluoroethylene-hexafluoropropylene), commercially sold under the trademark Teflon PFA, a product of E.I. DuPont DeNemours & Co., Inc. Wilmington, Del.; Teflon TFE, another product of DuPont; polyester materials such as poly (ethyleneterephthalate), commonly known as Mylar, a product of DuPont; or Kapton. Thermoplastics may be characterized as being temperature resistant (600° F. melting point) and flexible so that wall 60 will readily absorb and dissipate energy created by gas "poofs" which may occur in combustion chamber 32.

The integrity of radiation transmissive wall 60 is critical in order to effectively seal the gas fired burners 36 within combustion chamber 32 away from vaporized combustible solvents for obvious explosion prevention purposes. The sensing of the integrity of wall 60 may be readily accomplished by a sensing arrangement described in my earlier U.S. Pat. No. 3,849,063, issued on Nov. 19, 1974.

The radiation transmissive wall 60 may be further characterized as being approximately 0.002 inches thick and infrared transmissive or nonabsorbent in that only minor absorption in the range of approximately 3.4 mu occurs. In other words, transmissive wall 60 blocks only approximately three percent of the transmission of infrared generated by infrared burners 36.

Infrared cooling tubes 62 appropriately with aligned apertures 64 or the like are oriented in combustion chamber 32 so that apertures 64 confront the inner side of radiation transmissive wall 60 within combustion chamber 32. Cooling tubes 62 are preferably horizontally oriented and made from polished aluminum triangular in cross-section so that their reflective outer surfaces 66 confront radiating panels 54. Tubes 62 are fed cool or ambient room air through input ports 62 from cool air conduit 70 which receives air from fan 72 drawing ambient room air from conduit 74 (FIG. 4*b*). The fans 50 and 72 and conduits 52 and 74 of FIGS. 4*a* and 4*b* may be one in the same.

By this arrangement the melting of thermoplastic wall 60 is assuredly prevented. Before or shortly after burners 36 are ignited, ambient room air is forced out of apertures 64 to impinge upon and cool radiation transmissive wall 60. The air then goes downward while exhaust and combustion gases from burners 36 go upward within combustion chamber 32 which in effect creates a shear plane to prevent the hot combustion gases from contacting and melting the radiation transmissive wall 60.

Infrared radiant heater sources 30 appropriately may be interconnected by top parabolic reflector 76 and bottom parabolic reflector 78 both of which may be segmented for easy access within dryer 20 or suitably attached to combustion chambers 32 by any conventional means, such as a hinge 80 and fastener 90. Reflectors 76 and 78 appropriately may be made of polished aluminum to effectively reflect infrared radiation which otherwise may escape from infrared dryer 20.

A conventional flue 92 may appropriately be located above combustion chambers 32 for exhausting hot combustion gases and by-products out of the room. Stack 94 is provided on top of flue 92 whereat heat exchanger 96 (also seen in FIG. 5) is located which has a cool air input conduit 98 and a hot air output conduit 100. A stack fan 102 may appropriately be located above heat exchanger 96 (also seen in FIG. 5) which will aid in exhausting gases and facilitating heat exchanger 96.

Ambient room air buffer zone or space 104 is appropriately bounded only by combustion chambers 32 and top and bottom parabolic reflectors 76 and 78. Ambient room air absorbs virtually no infrared energy while yet providing a buffer zone between combustion chambers 32 and radiation transmissive drying tunnel 120 wherein combustible solvents are located. This buffer zone 104 arrangement provides yet another safety element in keeping the burners 36 away from any combustible gases or solvents.

Radiation transmissive drying tunnel 120 is positioned between infrared radiant heater sources 30 in the ambient room air buffer zone 104.

Drying tunnel 120 has radiation transmissive panels 122 forming the walls of drying tunnel 120 which are made of thermoplastic materials similar to the radiation transmissive walls 60 of combustion chambers 32. Virtually all absorbable infrared passing through panels 122 that could be absorbed by the thermalplastic material has previously been filtered thereout by the radiation transmissive walls 60 of combustion chambers 32.

Radiation transmissive panels 122 are suitably supported by top support rod 124 and bottom support rod 126 in conjunction with manifolds 142. Drying tunnel 120 also has a web entry wall 128 with a pressure actuated switch 130 therein along with a web entry opening 132. Opposing web entry wall 128 is web exit wall 134 with web exit opening 136 and drying tunnel exhaust ports 138. Walls 128 and 134 may be film panels, like panels 122, or may be metal panels.

Combustion inhibiting atmosphere (CIA) 140 is introduced within the radiation transmissive drying tunnel 120 to permeate the atmosphere therein. CIA 140 may simply be ambient room air having an approximate 35 percent carbon dioxide concentration therein which effectively makes the CIA 140 a flame retardant atmosphere virtually free of any explosion hazards. Other inert gases, such as nitrogen or argon, may replace the carbon dioxide. Halon gas is useful also, although it acts to interfere with combustion or oxidation rather than simply excluding oxygen. However, carbon dioxide is cheap and safe in concentrations far above those likely to result from massive leakage of the CIA 140 from the drying tunnel 120. Carbon dioxide also absorbs infrared radiation in the 7 mu band which makes it a desirable component of the CIA in that the carbon dioxide may be readily detected and regulated outside the effective infrared drying frequencies between 2–4 mu.

The flow of CIA 140 is directed into the drying tunnel 120 through manifolds 142 having manifold CIA air input ports 144. Air foils or nozzles 146 suitably connect opposing manifolds 142 and traverse the entire width of the web 10, so that air foils 146 are essentially oriented transversely with respect to the length of web 10. Air foils 146 are uniquely arranged in that they are above and below web 10 to not only direct CIA towards the web to carry away the vaporized combustible solvent, but also to support and assist the web as it travels through the drying tunnel 120. This arrangement is comparatively better than mechanical rollers for support of web 10 in that web 10 never comes into contact with any mechanical part of infrared dryer 20.

Tunnel entry air foils or nozzles 148 and tunnel exit air foils 150, located adjacent web entry opening 132 and exit 136, respectively, are also uniquely arranged in that they direct the flow of CIA 140 in curtain-like streams directly toward the travelling web 10 and from above and below the web. These streams of CIA from the foils contribute, in combination with the isopiestic balance of pressure within the tunnel as relates to the surrounding atmosphere, to minimize loss of CIA through the entry and exit ports 132, 136. The isopiestic balance is obtained by the CIA circulating, cooling and condensate collecting system illustrated in FIG. 6.

Referring to FIG. 6 in conjunction with FIG. 1, CIA cooling and condensate collection system or circuit 160 generally may be seen The tunnel exhaust ports 138 of the drying tunnel 120 are in flow communication with tunnel exhaust conduit 162 which has a controllable exhaust damper 164 therein. Beyond damper 164, the CIA 140 enters into the CIA cooling and condensate collection circuit 160 appropriately including filter 166, fan 168, air-to-air heat exchanger (condenser) 170, carbon dioxide monitor and supply control 172 connected to an appropriate source of compressed carbon dioxide (tank) 174, inlet damper 176 and CIA supply conduit 178 which is in flow communication with CIA manifold input ports 144.

Filter 166 essentially traps particles and large condensate molecules which are drawn out in droplet form. Filter 166 may be electrostatic in nature to further aid in the condensation of the vaporized combustible solvent. Fan 168 assures that the CIA laden with vaporized solvent does not become stagnant within drying tunnel 120 or the CIA cooling and condensate collection circuit 160. The air-to-air heat exchanger will not only cool the CIA but will act as a condenser and suitably should have a construction like a trough in its base with a float valve and outflow tube for collection of the condensed combustible solvent along with other by-products which may either be redistilled, burned as a fuel, or used for cleaning purposes.

The carbon dioxide monitor and supply control 172 will monitor the carbon dioxide amount or content within the CIA 140 and will add carbon dioxide from compressed carbon dioxide tank 174 when levels drop below a preferred 35 percent. Infrared Industries, Inc. of Santa Barbara, Calif. manufacture such a monitor and control known as an IR-703 single gas analyzer with an analog linearized display needle modified to turn on the carbon dioxide supply whenever the level drops below the predetermined norm.

The previously mentioned pressure actuated switch 130 conventionally controls and actuates dampers 164 and 176, suitably by a solenoid so that when pressures within drying tunnel 120 are greater than the pressures in the room, damper 176 in the CIA supply conduit 178 is moved towards a closed position while damper 164 in the exhaust conduit 162 is moved towards its open position. Dampers 164 and 176 move in the opposite direction when a negative pressure is sensed within drying tunnel 120 relative to the room atmosphere about dryer 20.

By this arrangement, the CIA 140 within the drying tunnel 120 is in isopiestic balance with respect to the ambient room air outside drying tunnel 120 to further assure that no CIA or concentrated vaporized combustible solvent escapes drying tunnel 120 through web entry opening 132 where air door tunnel entry airfoils 148 are located or through the web exit opening 136 tunnel exit airfoils 150 are situated.

The CIA flowing from foils 148 and 150 in curtain-like streams creates shear planes traversing the entrance and exit openings 132, 136 with the effect of an "air knife" as to minimize, in cooperation with the isopiestic balance between CIA and room air, escape of the CIA from the tunnel.

Referring to FIGS. 1, 3 and 5, the air impact preheater 190 of the infrared dryer 2 may be seen.

Preheater 190 comprises housing 192 with ceiling 194, floor 196, sidewalls 198, frontwall 200 with web entry opening 202, rear wall 204 with web exist opening 206 and housing exhaust ports 208.

Heated air 210 is directed from conventional heat exchanger 96 in stack 94 through hot air output conduit 100 into preheater manifold 212 through manifold import ports 214. Thereafter, the heated air 210 enters the atmosphere within the preheater housing 92 through air foils or nozzles 216 similarly constructed and arranged as airfoils 146 of the drying tunnel 120. Also, housing entry airfoil 218 and housing exit airfoils 220 are adjacent web entry and exit openings 202 and 206, respectively, where essentially the air knife effect is achieved to prevent the escape of heated air 210 into the ambient room atmosphere or drying tunnel 120.

Heated air laden with a portion of the vaporized combustible solvent leaves the preheater 190 through housing exhaust ports 208 which are in flow communication with cool air input conduit 98 which directs the cooled air 210 into heat exchanger 96. The total vaporized solvent which comes off web 10 within the preheater 190 is nominally in the 10 to 12 percent range of the total solvent that will be vaporized within infrared dryer 20. Therefore, there is little essential need for solvent recovery from preheater 190 for any pollution control purposes.

In operation, fans 168 and 72 are started to begin the CIA 140 flow through the drying tunnel 120 and to impinge cool air upon combustion chamber 32's radiation transmissive walls 60 through cooling tubes 62. Thereafter, fan 50 is started and Schwank-type burners 36 of the explosion-proof, pollution-free infrared dryer 20 are fired up preferably without the web 10 therein until the radiating panels 54 are irradiating infrared at their normal operating capacities and the exhaust temperatures within stack 94 approximately 800° F. With the aid of stack fan 102, heat exchanger 96 will have begun to output hot air in the range of 600°-700° F. which will be directed through hot air conduit 100 to airfoils 216, 218 and 220 of air impact preheater 190.

It has been found that desirable web speeds passing through the infrared dryer 20 are directly dependent upon the particular type of coating thereon to be dried, type of solvent used, how fast the printed web is leaving the coating applicator (printing press) and the BTU output in the form of infrared for burners 36. Web speeds in the range of 40 foot/minute to 2,000 foot/minute can be anticipated by this infrared dryer 20.

As the web 10 enters the air impact preheater 190, hot air 210 is impacted thereon through airfoils 216, 218 and 220 which will raise web 10's temperatures anywhere from 200° F. to 300° F. which has been found to drive off 10 to 12 percent of a solvent typically used for dispensing ink on web 10. This small amount of solvent may be removed out of dryer 20 through exhaust ports 208 to be exhausted out of the stack 94, possibly through heat exchanger 96.

As web 10 passes through the drying tunnel 120, its temperature may range anywhere from 180° F. to 450° F. dependent upon the types of solvent in the coating and the web speed. Infrared absorption by the web 10 generally is improved because it has been preheated.

As solvent becomes vaporized leaving the web 10 within the confines of drying tunnel 120, the CIA mixes with the solvent vapor as to prevent or minimize the possibility of ignition of the solvent by several affects. The flowing CIA prevents the vapor from obtaining the necessary oxygen for combustion; maintains the solvent in suspension to facilitate transporting of the solvent; cools the solvent vapor especially of those solvents with high boiling temperature, with the effect of condensing the vapor into a fog, which can be carried in greater amounts by the CIA than if the solvent remained in vapor form; and also carried the solvent, as a vapor or fog, rapidly away from the web 10 and from vicinity of the infrared source. The CIA subsequently flows from the tunnel to the cooling and condensate collection circuit 160. The CIA 140 within the drying tunnel 120 should be exhausted and replenished every one to two seconds and have its temperature maintained at approximately 80° F.

As the infrared dryer 20 operates a vapor or fog of combustible solvent is carried away by the CIA for reclamation, the CIA is monitored and controlled as it is recirculated back into the drying tunnel 120 through manifolds 142. Simultaneously, the pressure inside and outside drying tunnel 120 is monitored and controlled to prevent pressure differentials that may cause vaporized solvent leaks.

It should immediately be understood that all temperatures, CIA concentrations, and web speeds may vary dependent upon the type of web 10, coating thereon, particular solvent used and the size of the infrared dryer 20. That is, different temperatures and web speeds may be appropriate for adhesives and other coatings that are applied and dispersed with the aid of combustible solvents.

Figure 7:
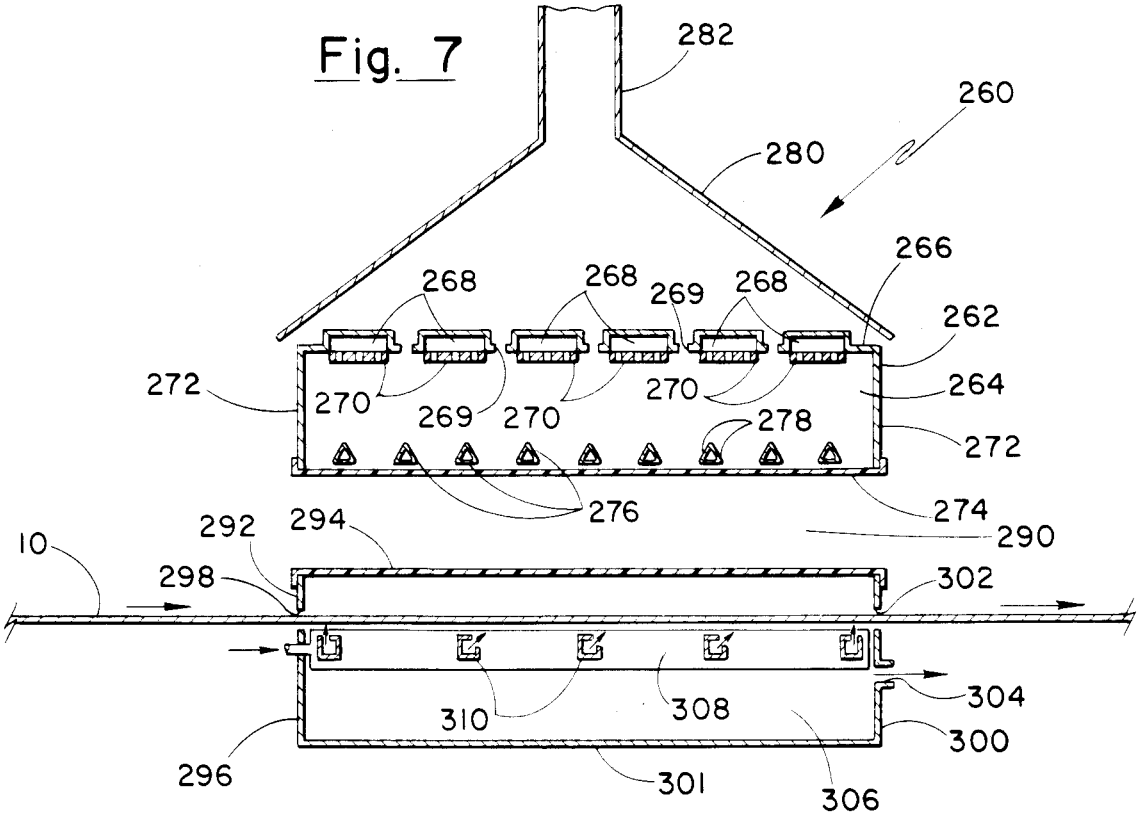
FIG. 7 is an longitudinal sectional view, of a modified embodiment of the infrared dryer of the invention.

FIG. 7 shows a modified form of the explosion-proof, pollution-free infrared dryer 260 which suitably may be used for webs 10 that have a newly applied coat on only one of its sides. The modified dryer 260 has a single horizontally oriented infrared radiant heater source 262 enclosed within a combustion chamber 264.

Combustion chamber 264 consists of mounting panel 266 wherein gas fired infrared Schwank-type burners 268 are mounted with mounting panel openings 269 therebetween. Radiating panels 270 of burners 268 are directed downwardly. Reflective combustion chamber sidewalls 272 and radiation transmissive panel or wall 274 (suitably a thermoplastic) complete the enclosure of combustion chamber 264. Cooling tubes 276 with their reflective outer surfaces 278 direct cool air onto the radiation transmissive panel 274. A flue 280 with stack 282 is conventionally mounted above combustion chamber 264 to properly direct the flow of combustion by-products and gases from the combustion chamber 264 through mounting panel openings 269 up through flue 280 and stack 282.

Ambient room air buffer zone 290 exists between horizontal heater source 262 and radiation-transmissive dryer tunnel 292. Dryer tunnel 292 is comprised of a radiation transmissive ceiling 294 (suitably made out of Teflon), tunnel entry wall 296 with web entry opening 298, tunnel exit wall 300 with web exit opening 302, drying tunnel floor 301 and tunnel exhaust port 304 located in exit wall 300. The flow of combustion inhibiting atmosphere (CIA) 306 is directed into the CIA manifolds 308 and exhausted from the dryer tunnel 292 similarly as previously disclosed. Airfoils 310 are also appropriately used in the dryer tunnel 292.

The present invention may be embodied in other specific forms without departing from the spirit or essential attributes thereof, and it is therefore desired that the present embodiments be considered in all respects as illustrative and not restrictive, reference being made to the appended claims rather than to the foregoing description to indicated the scope of the invention.

What is being claimed:

1. An explosion-proof, pollution-free infrared dryer for concentrated vaporization and removal of a combustible solvent from a newly coated product, comprising:

(a) a source of infrared radiation for vaporizing the combustible solvent from the product;

(b) a drying tunnel for surrounding and passing the product therethrough and having a radiation transmissive panel spaced from the source of infrared radiation and containing the combustible solvent vaporized by the infrared radiation applied through the panel and on to the product; and (c) means producing a flow of combustion inhibiting atmosphere through the drying tunnel for mixing with the vaporized solvent to prevent ignition thereof and to carry the solvent from the drying tunnel away from the product and infrared source.

2. The explosion-proof, pollution-free infrared dryer of claim 1 wherein the product comprises an elongate, traveling web and the combustible solvent is characteristically used to disperse the coating on the web, the tunnel having means for accommodating continuing travel of the web through the tunnel.

3. The explosion-proof, pollution-free infrared dryer of claim 2 wherein the drying tunnel has a web entry opening in one end and a web exit opening in an opposing end.

4. The explosion-proof, pollution-free infrared dryer of claim 2 wherein the flow of the combustion inhibiting atmosphere is introduced into the drying tunnel through a manifold in flow communication with foils directing the atmosphere towards the web.

5. The explosion-proof, pollution-free infrared dryer of claim 4 wherein the foils are positioned above and below the web of material to direct the atmosphere against the web to support the web and carry away the solvent vapor from the web.

6. The explosion-proof, pollution-free infrared dryer of claim 5 wherein opposing upper and lower air foils adjacent one end of the tunnel comprise an air door to keep ambient room air out of the tunnel and to keep vaporized solvent from escaping from the tunnel with the web.

7. The explosion-proof, pollution-free infrared dryer of claim 2, further comprising an air impact preheater for passing the web therethrough for hot air impact before its entrance into the drying tunnel to vaporize a portion of the combustible solvent and to improve infrared absorption of the web within the drying tunnel.

8. The explosion-proof, pollution-free infrared dryer of claim 7, further comprising a heat exchanger through which hot exhaust gases from the infrared source pass for heating air to be used in the hot air impact drying of the preheater.

9. The explosion-proof, pollution-free infrared dryer of claim 8 wherein the hot air for hot air impact drying is introduced into the preheater from the infrared source exhaust heat exchanger through a preheater manifold in flow communication with air foils directing hot air toward the web after which the solvent-laden hot air is removed from the preheater assembly through a preheater exhaust port.

10. The explosion-proof, pollution-free infrared dryer of claim 9 wherein the preheater air foils are positioned above and below the web of material to effectively support the web without touching it and to carry away the vaporizing solvent from the web.

11. The explosion-proof, pollution-free infrared dryer of claim 10 wherein the preheater has a web entry opening and an opposing web exit opening and the opposing upper and lower air foils adjacent the tunnel entry and exit openings to keep ambient room air out of the preheater and to keep vaporized solvent from escaping from the preheater entry and exit openings.

12. The explosion-proof, pollution-free infrared dryer of claim 2 and a combustion inhibiting atmosphere circulating system having means for supplying and withdrawing the atmosphere to and from the tunnel and maintaining substantial isopiestic balance between the atmosphere in the tunnel and the air outside the tunnel.

13. The explosion-proof, pollution-free infrared dryer of claim 12 wherein said circulating system includes means for cooling and collecting solvent from the atmosphere.

14. The explosion-proof, pollution-free infrared dryer of claim 2 wherein said source of infrared radiation is elongate and is oriented substantially upright adjacent one edge of the web and in spaced relation thereto.

15. The explosion-proof, pollution-free infrared dryer of claim 2, wherein the atmosphere is comprised of a flame retardant atmosphere free of an explosion hazard containing adequate amounts of gas selected from a group comprising carbon dioxide, nitrogen, argon and halon.

16. The explosion-proof, pollution-free infrared dryer of claim 1, further comprising an atmosphere monitor, supply and control means for monitoring and replenishing the atmosphere to maintain the combustion inhibiting atmosphere within the drying tunnel.

17. The explosion-proof, pollution-free infrared dryer of claim 2 wherein the combustion inhibiting atmosphere contains approximately 30 to 40 percent carbon dioxide.

18. The explosion-proof, pollution-free infrared dryer of claim 1, further comprising at least one cooling tube within the combustion chamber adjacent the panel and having at least one aperture oriented so that the aperture confronts the radiation transmissive panel through which pressurized cool air in the tube may impinge upon and cool the radiation transmissive wall.

19. The explosion-proof, pollution-free infrared dryer of claim 18 wherein there is a plurality of aligned apertures along the length of the tube, the tube having reflective surfaces facing the infrared source.

20. The explosion-proof, pollution-free infrared dryer of claim 1, wherein the radiation-transmissive wall and panel are comprised of a thermoplastic film.

21. The explosion-proof, pollution-free infrared dryer of claim 1, further comprising a second source of infrared radiation said infrared sources being oriented substantially upright and in confronting relation to each other, the tunnel being elongate and oriented generally horizontally and between said sources.

22. The explosion-proof, pollution-free infrared dryer of claim 1 wherein an ambient room air buffer zone exists between the infrared source and the drying tunnel.

23. The explosion-proof, pollution-free infrared dryer of claim 1 wherein the infrared radiation source is comprised of a gas-fired Schwank-type infrared burner.

24. An explosion-proof, pollution-free infrared dryer for concentrated vaporization and removal of a combustible solvent from a newly coated product, comprising:

(a) a pair of infrared radiation sources spaced and opposing each other for vaporization of the combustible solvent from the product wherein each of the sources is housed within a chamber having a radiation transmissive wall confronting the infrared source;

(b) a drying tunnel positioned adjacent the infrared sources for surrounding and passing the product therethrough and having radiation transmissive panel means for containing combustible solvent vaporized by the radiation of the infrared sources through the radiation transmissive walls and panel upon the product; and (c) means producing a flow of atmosphere through the drying tunnel for mixing with the vaporized solvent to prevent ignition of the solvent and to carry the solvent away from the product and away from the vicinity of the infrared sources.

25. An infrared dryer for concentrated vaporization and removal of a combustible solvent from a newly coated traveling web, comprising:

(a) a source of infrared radiation confronting the web for vaporizing the combustible solvent in the coating;

(b) means defining a drying station and separating said source from the traveling web, said means including radiation transmissive membrane separating the combustible solvent vaporized from the coating of the web from the infrared source; and (c) an air impact preheater adjacent the drying station and impinging the web with hot air before its entrance into the drying station to preheat the web to thereby improve infrared absorption of the product within the drying station and to vaporize a portion of the combustible solvent.

26. A pollution-free infrared dryer for concentrated vaporization and removal of a combustible solvent from a newly coated traveling web, comprising:

(a) a source of infrared radiation for vaporizing the combustible solvent from the web;

(b) a drying tunnel for surrounding and passing the web therethrough and having a radiation transmissive panel spaced from the infrared source for containing the combustible solvent vaporized by the irradiation of infrared upon the web, the tunnel having entrance and exit openings for the traveling web as it moves between room air and the interior of the tunnel;

(c) means producing a flow of solvent vapor exhausting atmosphere through the drying tunnel for cooling the web and removing the vaporized combustible solvent from the drying tunnel away from the web and infrared source; and (d) said means having flow controls for the vapor exhausting atmosphere and balancing the pressure in the tunnel with room air to minimize loss of the atmosphere into the room air.

27. An infrared dryer for concentrated vaporization and removal of a combustible solvent from a newly coated traveling web, comprising:

(a) a source of infrared radiation for vaporizing the combustible solvent from the web and means defining a combustion chamber adjacent the source and having a radiation transmissive wall confronting the infrared source;

(b) a drying station through which the web travels adjacent the radiation transmissive wall to receive the infrared transmitted through the wall;

(c) a radiation transmissive wall cooling means including an elongate air delivery manifold tube in the combustion chamber transversing the well in closely spaced relation and having a multiplicity of orifices directing air to impinge onto the transmissive wall.

28. The dryer according to claim 27 wherein said tube has a V-shaped side confronting the infrared source and has reflective surfaces at said V-shaped side.

29. An explosion-proof, pollution-free infrared dryer for concentrated vaporization and removal of a combustible solvent from a newly coated traveling web, comprising:

(a) a source of infrared radiation for vaporizing the combustible solvent from the web wherein the source is housed within a chamber having a radiation transmissive wall confronting the infrared source;

(b) a drying tunnel for surrounding and passing the web therethrough with a radiation transmissive panel spaced from the radiation transmissive wall for containing and concentrating the combustible solvent vaporized by the irradiation of infrared source through the radiation transmissive wall and panel upon the web;

(c) a flow of combustion-inhibiting atmosphere through the drying tunnel for cooling the product and removing the concentrated, vaporized combustible solvent from the drying tunnel away from the web and infrared source; and (d) airfoils through which the flow of combustion inhibiting atmosphere is introduced into the drying tunnel which are positioned above and below the location of the web to effectively support the web and carry away concentrated vaporized combustible solvent from the web.

30. An explosion-proof, pollution-free infrared dryer for concentrated vaporization and removal of a combustible solvent from a newly coated web comprising:

(a) a pair of infrared radiation sources spaced and opposing each other for vaporization of the combustible solvent from the web wherein each of the sources is housed within a chamber having a radiation transmissive wall confronting the infrared source;

(b) at least one cooling tube within each combustion chamber with at least one aperture oriented so that the aperture confronts the radiation transmissive wall through which pressurized cool air may impinge upon and cool the radiation transmissive wall;

(c) a drying tunnel positioned between the infrared sources for surrounding and passing the web therethrough with a radiation transmissive panel for containing and concentrating combustible solvent vaporized by the irradiation of the infrared sources through the radiation transmissive walls and panel upon the web;

(d) a flow of combustion inhibiting atmosphere through the drying tunnel for cooling the web and removing the concentrated vaporized combustible solvent from the drying tunnel away from the web and infrared sources;

(e) airfoils through which the flow of combustion inhibiting atmosphere is introduced into the drying tunnel which are positioned above and below the location of the web to effectively support the web and carry away concentrated vaporized combustible solvent from the web; and (f) an air impact preheater for passing the web therethrough for hot air impact drying before its entrance into the drying tunnel to vaporize a portion of the combustible solvent and to improve infrared absorption of the web within the drying tunnel.

31. A method of drying a solvent-containing coating on an elongate traveling web (a) comprising passing the web through an enclosed tunnel (b) directing infrared from an infrared source onto the web to vaporize the solvent, (c) flowing a combustion inhibiting atmosphere through and out of the tunnel to cool and carry the vapor away, (d) and physically isolating the infrared source from the atmosphere in the tunnel while continuing to direct the innrared onto the web.

32. The infrared dryer according to claim 2 and having means removing solvent from the combustion inhibiting atmosphere after the atmosphere has been carried away from the tunnel.

33. The infrared dryer according to claim 32 and said means producing flow of combustion inhibiting atmosphere including entrance and exit ports for the atmosphere adjacent said means for accommodating continuing travel of the web through the tunnel.

34. The infrared dryer according to claim 32 and said means producing flow of combustion inhibiting atmosphere also returning the combustion inhibiting atmosphere to the tunnel after the solvent has been removed from the atmosphere.

35. The infrared dryer according to claim 19, wherein the reflective surfaces of the tube are oriented obliquely with respect to the infrared source.

36. The infrared dryer according to claim 22, wherein the source of infrared radiation has an open flame generating infrared and producing combustion gases, and a second infrared transmissive panel between the source of radiation and the ambient room air buffer zone to isolate the buffer zone from the source of infrared radiation and the combustion gases generated thereby.

* * * * *

UNITED STATES PATENT AND TRADEMARK OFFICE

CERTIFICATE OF CORRECTION

PATENT NO. : 4,798,007

DATED : January 17, 1989

INVENTOR(S) : John E. Eichenlaub

It is certified that error appears in the above-identified patent and that said Letters Patent is hereby corrected as shown below:

Column 2,line 53, delete "inrared" and replace it with --by the infrared--.

Column 2, line 54, delete the first occurence of "flow".

Column 4, line 27, "ambient from air" should read --ambient room air--.

Signed and Sealed this

Thirtieth Day of January, 1990

*Attest:*

JEFFREY M. SAMUELS

*Attesting Officer*

*Acting Commissioner of Patents and Trademarks*